US006361011B1

(12) United States Patent
Brutsaert

(10) Patent No.: US 6,361,011 B1
(45) Date of Patent: Mar. 26, 2002

(54) DEVICE FOR ATTACHING A COLLAPSIBLE CANOPY TO A VEHICLE

(75) Inventor: Louis Marcel Brutsaert, Menen (BE)

(73) Assignee: Omnistor Accessories nv (BE)

( * ) Notice: Subject to any disclaimer, the term of this patent is extended or adjusted under 35 U.S.C. 154(b) by 0 days.

(21) Appl. No.: 09/635,589

(22) Filed: Aug. 9, 2000

(30) Foreign Application Priority Data

Aug. 11, 1999 (FR) ..... 99 10404

(51) Int. Cl.[7] ..... A47F 5/00

(52) U.S. Cl. ..... 248/316.8; 160/66; 248/503; 248/510

(58) Field of Search ..... 248/316.8, 309.1, 248/220.21, 222.14, 345, 503, 510, 273; 160/66, 67

(56) References Cited

U.S. PATENT DOCUMENTS 5,326,007 A * 7/1994 Pudney et al. ..... 224/321
5,375,750 A * 12/1994 Mandarino et al. ..... 224/321
5,819,830 A * 10/1998 Verelst ..... 160/66 X

FOREIGN PATENT DOCUMENTS

| | | |
|---|---|---|
| DE | 29722816 | 2/1998 |
| DE | 19731898 | 2/1999 |

* cited by examiner

*Primary Examiner*—Ramon O. Ramirez
(74) *Attorney, Agent, or Firm*—Bacon & Thomas, PLLC

(57) ABSTRACT

A device for attaching a collapsible canopy having fittings to an exterior surface of a vehicle includes two elongated parallel rails mounted on the exterior surface in spaced apart parallel relation, two carriages each slidably mounted along a longitudinal axis on a respective rail, two clips each mounted on a respective carriage and arranged to cooperate with the canopy fittings and two adjustment elements each mounted along a respective rail and cooperating with respective clips and carriages. Each of the adjustment elements has an upper portion that defines a stair-shaped profile arranged to cooperate with the canopy fittings.

10 Claims, 4 Drawing Sheets

DEVICE FOR ATTACHING A COLLAPSIBLE CANOPY TO A VEHICLE

BACKGROUND OF THE INVENTION

The present invention concerns a device for fixing a collapsible canopy to the roof of a trailer, a camper or the like.

In particular, the invention concerns a device for fixing a collapsible canopy to such a roof, whereby the device can be used to mount a canopy on practically any camper whatsoever or on practically any trailer whatsoever, and whereby the canopy, when being mounted, can be adjusted such that it fits perfectly onto the edge of the existing roof of the camper, the trailer or the like.

As the canopies which are known up to now can only be mounted in a single fixing position, a perfect connection between the canopy and the roof edge of the camper or the trailer is only rarely obtained.

Consequently, as there usually remains a slit between the canopy and the roof edge, the wind will have more hold on the canopy, such that the device for fixing the canopy has to resist greater loads.

The invention aims a device for fixing a collapsible canopy onto the roof of a trailer, a camper or the like, which remedies the above-mentioned and other disadvantages.

SUMMARY OF THE INVENTION

To this end, the present invention concerns a device for fixing a collapsible canopy onto the roof of a trailer, a camper or the like, which includes two parallel rails; a carriage on each rail which can move in the longitudinal direction of the rail; a clip, pivoting on the carriage, for fixing the collapsible canopy; and an adjustment element between each rail and the corresponding clip.

DESCRIPTION OF THE DRAWINGS

In order to better explain the characteristics of the invention, the following preferred embodiment according to the invention is described as an example only without being limitative in any way, with reference to the accompanying drawings, in which.

DESCRIPTION OF THE PREFERRED EMBODIMENTS

Figure 1:
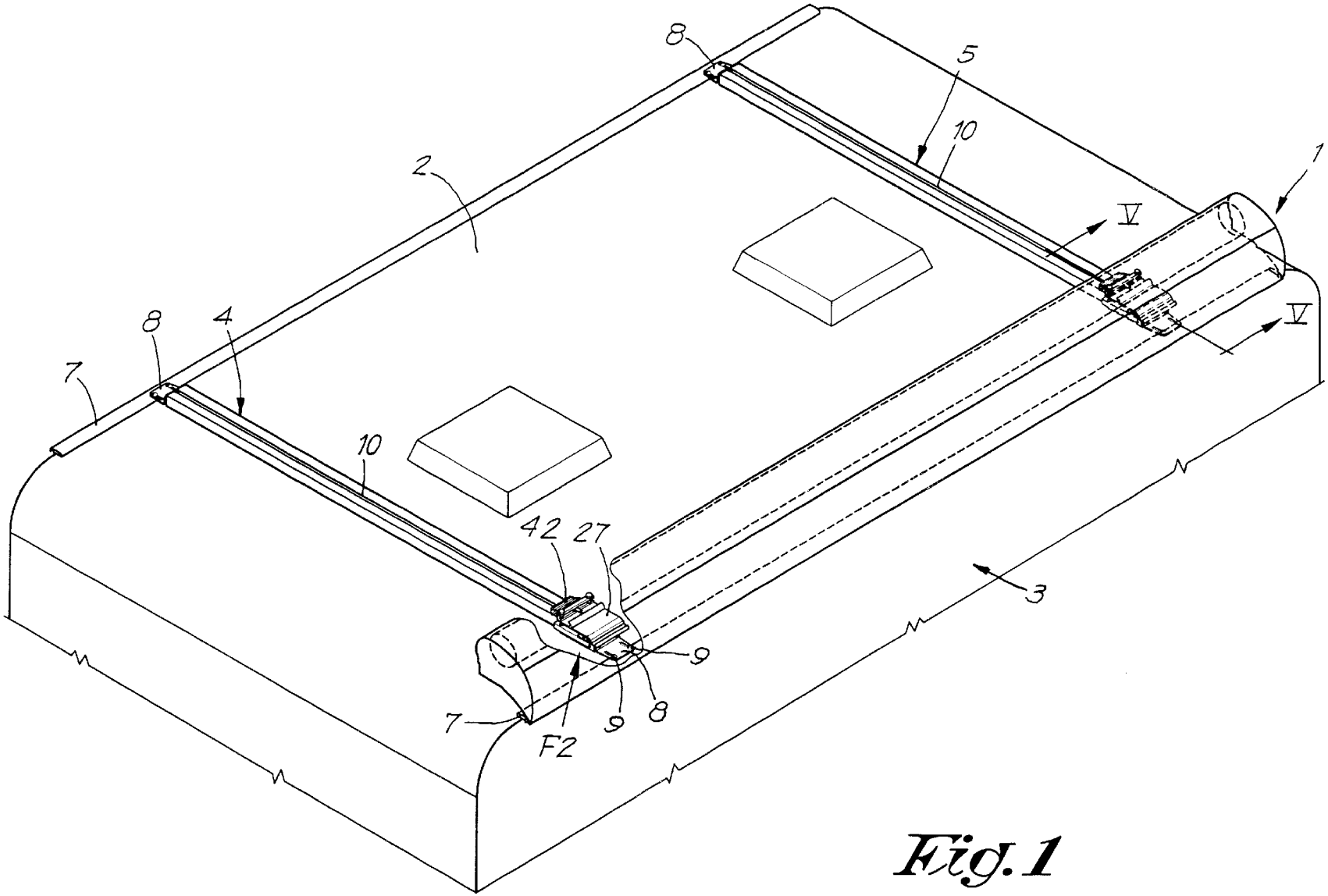
FIG. 1 represents a view in perspective of a roof onto which is fixed a canopy by means of a device according to the invention, with a partial section of said canopy.
Figure 3:
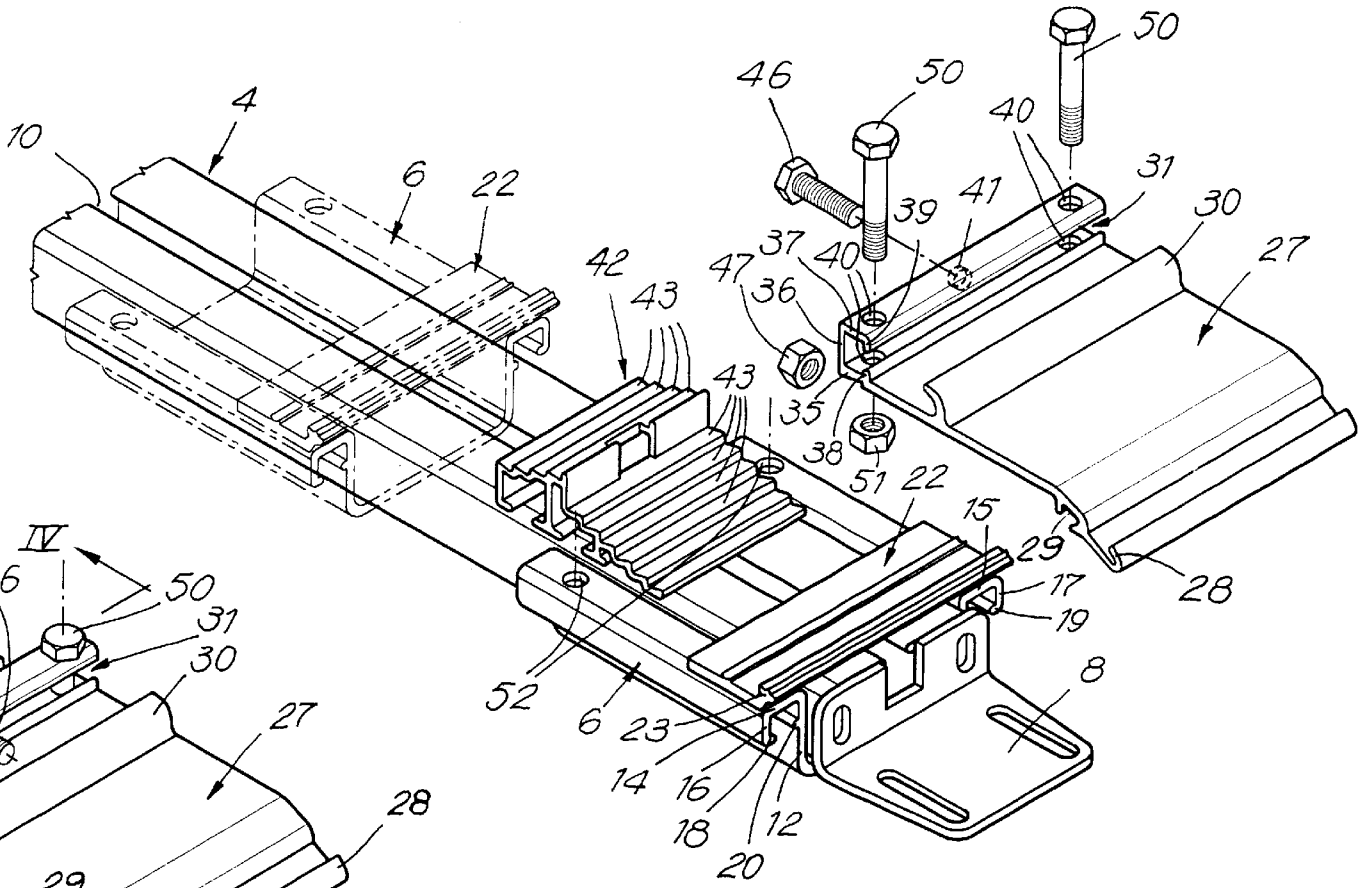
FIG. 3 represents a view analogous to that in FIG. 2, but whereby the device according to the invention has been dismounted.
Figure 2:
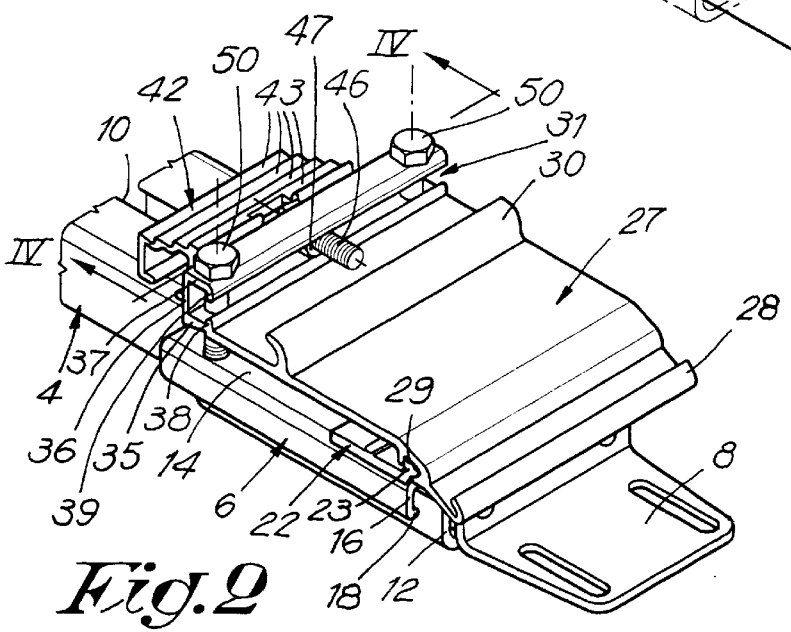
FIG. 2 represents the part indicated by F2 in FIG. 1 to a larger scale.
Figure 4:
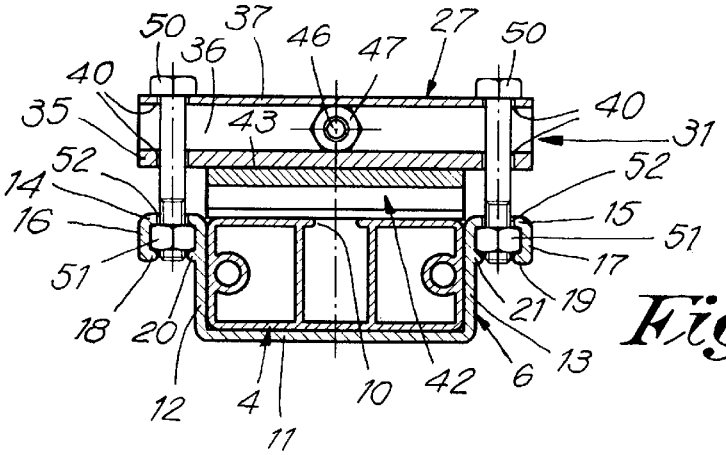
FIG. 4 represents a cross section according to line IV—IV in FIG. 2.
Figure 7:
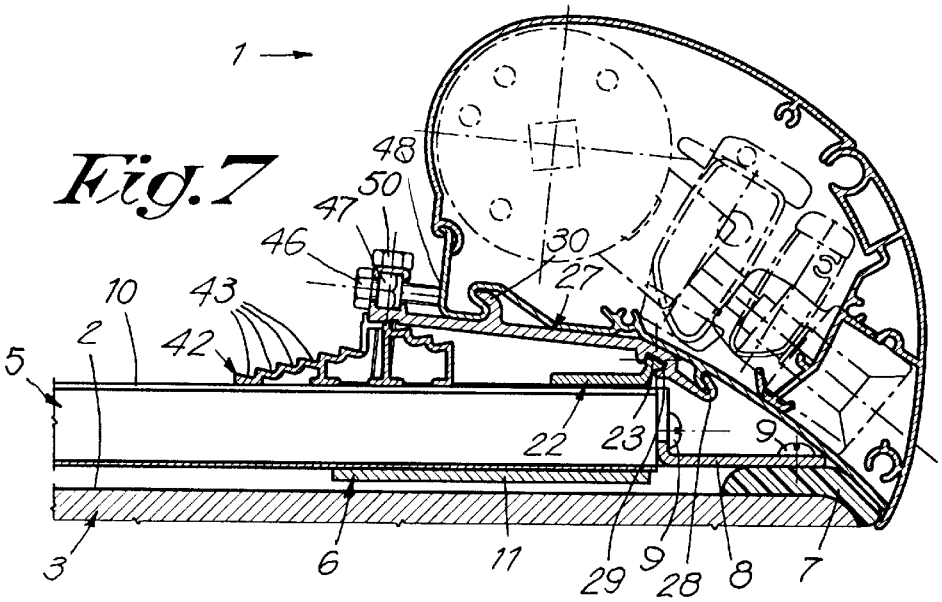
FIGS. 7 and 8 represent views to a smaller scale, analogous to those in FIG. 5, but whereby the connecting section is situated in its highest position, in its lowest position respectively.
Figure 8:
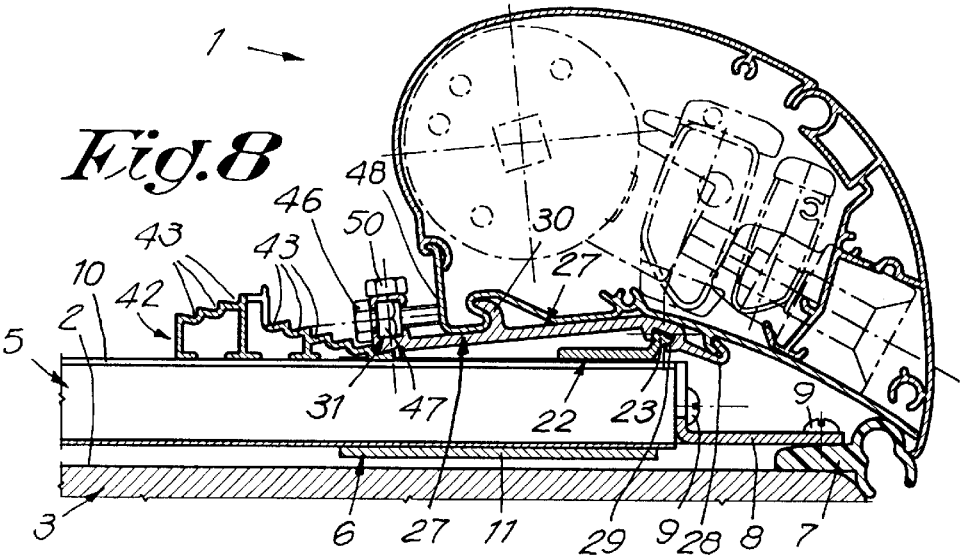
Figures 5, 6:
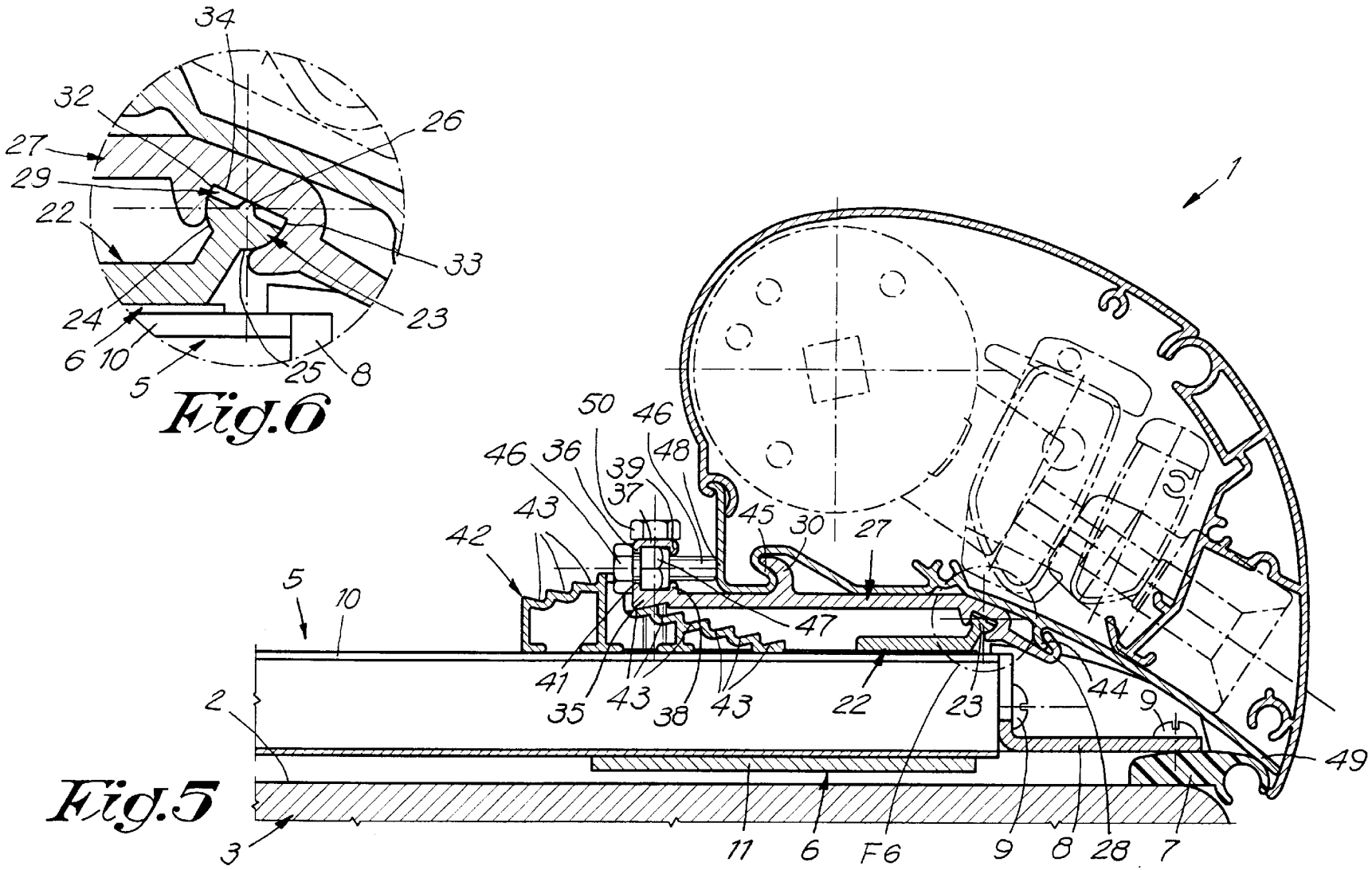
FIG. 5 represents a cross section according to line V—V in FIG. 1, to a larger scale.
FIG. 6 represents the part indicated by F6 in FIG. 5 to an even larger scale.

A device according to the invention for fixing a collapsible canopy 1 onto the roof 2 of a trailer, a camper or the like

3 consists of at least two rails 4–5 over which are mounted moving carriages 6. The rails 4–5 are fixed crosswise to the edges 7 of the roof by means of L-shaped sections 8 and screws 9.

The rails 4–5 are preferably made of tubular sections having a rectangular cross section with a longitudinal groove 10 on their top side, such that also other accessories such as luggage grids or the like can be fixed onto these rails.

The carriages 6 are mainly made of a section whose shape is that of an inverse omega, whose bottom 11 is provided under the corresponding rail 4–5 and whose sides 12–13 are provided next to the above-mentioned rails. Finally, the protruding walls 14–15 of this inverse omega-shaped section have fixing edges on their far ends placed in another position 16–17, whereas ribs 18–19 and 20–21 respectively which are directed towards one another, are provided on the free end of the fixing edges 16–17 as well as on the side which is adjacent to the walls 12–13.

Over the corresponding rails 4–5, each carriage 6 is made of a connecting bridge 22 which is fixed onto the protruding walls 14–15, for example by means of welding.

Said connecting bridge 22 is equipped, in its top part, with a tooth 23 which is more or less T-shaped and which extends in the longitudinal direction of the connecting bridge 22. The head of said T-shaped tooth 23 has curved, lateral surfaces 24–25, and the top wall of said tooth 23 has a rib 26.

The device according to the invention further consists of a clip 27 which successively represents, as of the front edge to the back edge, a hook 28 which is directed upward, a downward directed groove 29, a second upward directed hook 30 and a duct 31 provided over it.

The above-mentioned groove 29 preferably has curved, lateral walls 32–33 which are mutually connected via the bottom 34 of the groove 29.

The above-mentioned duct 31 consists of three walls 35–36–37, whereby ribs 38–39 which are directed towards one another are provided on the walls 35–37.

In the walls 35–37 are provided two pairs of holes 40, whereas a hole 41 is provided in the wall 36.

Finally, the device according to the invention is used with an adjustment element 42 which is made such that it can rest in an appropriate manner on a rail 4–5 with its lower portion, whereas the upper portion defines a stair-shaped profile and to this end has different steps 43 which are all provided at different heights.

The mounting of a canopy 1 by means of a mechanism according to the invention is very simple and as follows.

First of all, the rails 4–5 are fixed onto the edges 7 of the roof by means of the above-mentioned L-shaped sections 8 and the screws 9, after a carriage 6 has been provided on each rail 4–5.

Then, the clip 27 is shifted over the tooth 23 by means of the groove 29, such that the curved lateral walls 32–33 of the groove 29 can pivot against the curved lateral walls 24–25 of the tooth 23, and such that the bottom 34 of the groove 29 rests on the rib 26 of the tooth 23 in order to facilitate the pivoting of the clip 27 in relation to the tooth 23.

At this moment, the canopy 1 can be placed on the clip 27, such that the protrusions 44–45 of the protrusion 1 catch in the hooks 28–30 of the clip 27; next a screw 46 is screwed in a nut 47 through the hole .41 of the clip 27, such that the far end of the screw 46 rests against the wall 48 of the canopy 1 so as to press the canopy in the clip 27.

It is clear that the center distance of the axes between the clips 27 preferably corresponds to the center distance of the axes between the rails 4–5.

In particular cases, it is possible, however, to make the clips 27 larger, such that either of the two clips 27 will be fixed onto the rails .4–5 in an asymmetrical manner. This characteristic will be preferred when the rails 4–5 cannot be fixed in the ideal place, because a roof awning or the like is present.

In order to optimize the distribution of energy on the canopy 1, the clips 27 can be either made larger as described above, or they can be replaced by a continuous clip which is fixed to the two rails 4–5.

In order to be able to screw the screw 46 in the nut 47, said nut 47 is shifted in the duct 31 of the clip 27, such that it performs an antirotation between the walls 35–36–37 and the ribs 38–39 at the height of the hole 41 provided in the wall 36.

Next, the canopy 1 is made to pivot around the tooth 23 of the T-shaped clip 27, which is made considerably easier thanks to the fact that the bottom. 34 of the groove 29 rests on the rib 26 of the tooth 23, as well as by the curved lateral walls 32–33 and 24–25 of the groove 29, of the tooth 23 respectively, until the wall 49 of the canopy 1 fits perfectly to the edge 7 of the roof of the trailer, the camper or the like 3.

Then, the adjustment element 42 is mounted in a position between the wall 35 of the duct 31 of the clip 27 on the one hand, and the top side of the rail 4–5 on the other hand, such that the canopy 1 is fixed as mentioned above.

Finally, the clip 27 is clamped on the carriage 6 by means of screws 50 and nuts 51, such that the adjustment element 42 is simultaneously clamped in the selection or predetermined position.

To this end, the nuts 51 are shifted in the ducts formed by the sides 12–13 of the omega-shaped section, by the protruding walls 14–15, by the fixing edges 16–17 and by the ribs 18–20 and 19–21 which are directed towards one another; then, the screws 50 are pressed through the holes 40 of the clip 27 and through the corresponding holes 52 provided in the protruding walls 14–15, into the nuts 51.

It is clear that a device for fixing a collapsible canopy to a roof is obtained in this manner, which makes it possible to mount a collapsible canopy onto the roof of any trailer or of any camper whatsoever in a very simple manner, whereby the device according to the invention makes the canopy fit perfectly onto the roof edge of the above-mentioned camper, trailer or the like, which is made possible among others thanks to the fact that the adjusting element has two series of steps upon which the rear end of the clip can rest and can be held so as to make the canopy fit perfectly onto the roof edge.

The invention is by no means limited to the above-described embodiments represented in the accompanying drawings; on the contrary, such a device can be made in all sorts of variants while still remaining within the scope of the invention.

What is claimed is:

1. A device for attaching a collapsible canopy having fittings to an exterior surface of a vehicle comprising:

at least two elongated parallel rails mounted on said exterior surface in spaced apart parallel relation;

at least two carriages, each slidably mounted along a longitudinal axis on a respective one of said rails;

at least two clips, each mounted to a respective one of said carriages and arranged to cooperate with said canopy fittings; and at least two adjustment elements, each mounted along a respective one of said rails and cooperating with a respective one of said clips and carriages, wherein each of said adjustment elements forms an upper portion defining a stair-shaped profile cooperating with said canopy fittings.

2. The device according to claim 1 wherein each of said carriages has an inverse omega shaped cross-section which defines a bottom surface and a pair of oppositely opposed side parts each extending outwardly from said longitudinal axis of a respective one of said rails, said bottom surface cooperating with a lower surface of said respective one of said rails, wherein a connecting bridge is attached to each pair of said side parts and spans above an upper surface of said respective one of said rails.

3. The device according to claim 2 wherein the connecting bridge defines a top portion having a T-shaped tooth extending along a longitudinal direction of said connecting bridge normal to said longitudinal axis of a respective one of said rails, said T-shaped tooth having curved, lateral side surfaces and a top surface defining a rib disposed along a predetermined length of the top portion in the longitudinal direction.

4. The device according to claim 3 wherein said T-shaped tooth of said connecting bridge is configured and dimensioned to engage with said medial groove of said clip such that said rib communicates with said bottom portion of said clip.

5. The device according to claim 1 wherein each of said clips defines a proximal hook, a medial groove having curved lateral walls connecting to a bottom portion thereof, a medial-distal hook and a distal duct located at an end of said clip and extending above said medial-distal hook; said proximal hook, said medial groove, said medial-distal hook and said distal duct being spaced along a longitudinal length of said clip.

6. The device according to claim 5 wherein said canopy fittings include a distal wall and a plurality of protrusions configured and dimensioned to cooperate with said proximal hook, said medial-distal hook and said distal duct of said clip, said distal duct defining a through-hole whereat fastener elements are mounted and cooperate therewith to secure said distal wall of said canopy with said duct.

7. The device according to claim 1 wherein each of said adjustment elements defines a lower portion configured and dimensioned to slidably engage a respective one of said rails.

8. The device according to claim 1 further comprising L-shaped brackets and fasteners configured and dimensioned to attach each of said rails to said exterior surface.

9. The device according to claim 1 wherein the stair-shaped profile of said adjustment elements defines a plurality of steps having different heights.

10. The device according to claim 1 wherein each of said clips are attached to a respective one of said carriages by a plurality of fasteners, each of said adjustment elements being positioned along a respective one of said rails in a predetermined position with respect to a respective one of said clips.

* * * * *